United States Patent [19]

Ogita

[11] 4,437,506

[45] Mar. 20, 1984

[54] CURTAIN DRAWER ARRANGEMENT

[75] Inventor: Koichi Ogita, Tokorozawa, Japan

[73] Assignee: Yokota Co., Ltd., Japan

[21] Appl. No.: 290,736

[22] Filed: Aug. 6, 1981

[30] Foreign Application Priority Data

Jul. 2, 1981 [JP] Japan ..... 56-102225

[51] Int. Cl.[3] ..... A47H 1/00; A47H 5/00

[52] U.S. Cl. ..... 160/331

[58] Field of Search ..... 160/331, 346, 345

[56] References Cited

U.S. PATENT DOCUMENTS

| | | | |
|---|---|---|---|
| 3,098,520 | 7/1963 | Greenstadt | 160/346 |
| 3,297,078 | 1/1967 | Miki | 160/331 |
| 3,331,428 | 7/1967 | Ford | 160/331 |
| 3,374,823 | 3/1968 | Ford | 160/331 |

*Primary Examiner*—Peter M. Caun
*Assistant Examiner*—Cherney S. Lieberman
*Attorney, Agent, or Firm*—Irvin A. Lavine

[57] ABSTRACT

A curtain drawer arrangement comprises a curtain rail and a plurality of curtain runners and a motor-driven mechanism depending therefrom. The curtain rail is provided with a lead plate having a conductive lead line of a greater width and a conductive lead line of a smaller width. Brushes are disposed in the motor-driven mechanism and engage the lead line of a greater width. Another brush is disposed in the mechanism and engages the lead line of a smaller width. A collector is connected to a reversible motor. The motor-driven mechanism is also provided with tired wheels which rotate in response to the actuation of the reversible motor. A control panel for drawing or opening the curtain is connected with both the lead lines.

6 Claims, 7 Drawing Figures

CURTAIN DRAWER ARRANGEMENT

BACKGROUND OF THE INVENTION

The present invention relates to a curtain drawer arrangement, in particular, of the type wherein the curtain is drawn closed or open by movement of multiple curtain runners by a motor-driven mechanism adapted to depend from a curtain rail, together with the runners.

In the prior art arrangement designed for use in curtains of relatively small sizes such as domestic curtains or those used in office rooms of small dimensions, it has been proposed to move curtain runners by an electromotor depending from a curtain rail for the purpose of drawing or opening a curtain. This conventional arrangement is designed in such a manner that the motor-driven mechanism per se travels along the tracks of a curtain rail on the wheels mounted thereon, and operates effectively where the curtain depending from the curtain runners is of lighter weight. When the curtain is of increased weight, however, there is a fear that neither drawing nor opening of the curtain may take place due to the fact that the wheels of the motor-driven mechanism spin without providing traction. To prevent the wheels of the motor-driven mechanism from spinning, the weight of the mechanism per se may be increased. However, this makes the motor-driven mechanism over-sized and the arrangement's appearance unattractive. In addition, the arrangement is complicated in its entirety, and is therefore unsuitable for use in curtains of relatively small sizes such as those employed in houses and in small office rooms. This known arrangement also uses a limit switch attached to the curtain rail to pass current through the motor-driven mechanism. In use, the limit switch often suffers failures as a result of the motor-driven mechanism colliding therewith. There is also a possibility that, with the motor-driven mechanism of increased weight, a limit switch failure may cause a malfunction of the curtain-drawing arrangement. Accordingly, there is now a strong demand for a curtain-drawing arrangement or machine which can provide a solution to the above-mentioned problems.

SUMMARY OF THE INVENTION

It is therefore a main object of the present invention to provide a curtain drawer arrangement suitable for use in curtains of relatively small sizes such as those employed in houses and small office rooms, which assures normal travelling of the motor-driven mechanism and is free from any current conduction failures. Another object of the present invention is to provide a curtain drawer arrangement which is also effective in drawing tableau curtains or super-sized curtains such as those used in large-sized conference rooms.

BRIEF DESCRIPTION OF THE DRAWINGS

The above-mentioned and other objects and advantages of the present invention will now become apparent from a reading of the following description with reference to the accompanying drawings, in which.

DETAILED DESCRIPTION OF PREFERRED EMBODIMENT

Figure 1:
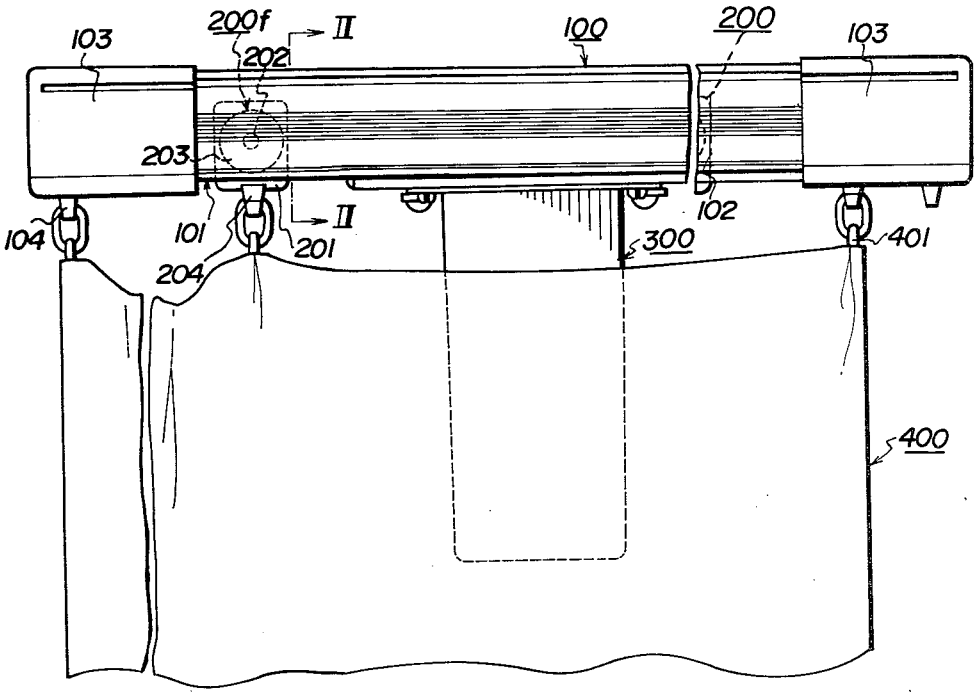
FIG. 1 is a front view of the curtain drawer arrangement according to the present invention with the curtain rail being partially cut away.

Referring to FIG. 1, there is shown a curtain drawer arrangment according to the present invention comprising a curtain rail 100, a plurality of curtain runners 200, a motor-driven mechanism 300 and a curtain 400. Drawing the curtain is effected by moving the motor-driven mechanism 300 which depends from the curtain rail 100 together with the curtain runners 200.

Figure 2:
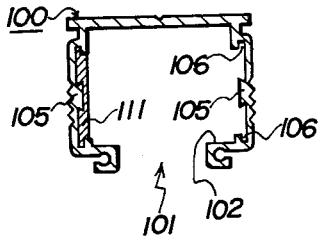
FIG. 2 is a sectional view taken along the line II—II of FIG. 1, showing the curtain rail and the lead plate.

The curtain rail 100 includes a longitudinally elongated slot 101 in the center of its bottom member and a pair of tracks 102 formed by the inner faces thereof, as shown in FIG. 2. The curtain rail 100 has at both ends stoppers 103 provided on their lower sides with engaging members 104 in annular form (see FIG. 1). The curtain rail 100 also has on its side members projections 105 which have a dove tail sectional shape, and in the upper and lower ends thereof grooves 106 which are concave in section. A lead plate 111 is mounted on the rail in such a manner that it engages with the projection 105 and the grooves 106.

Figure 3:
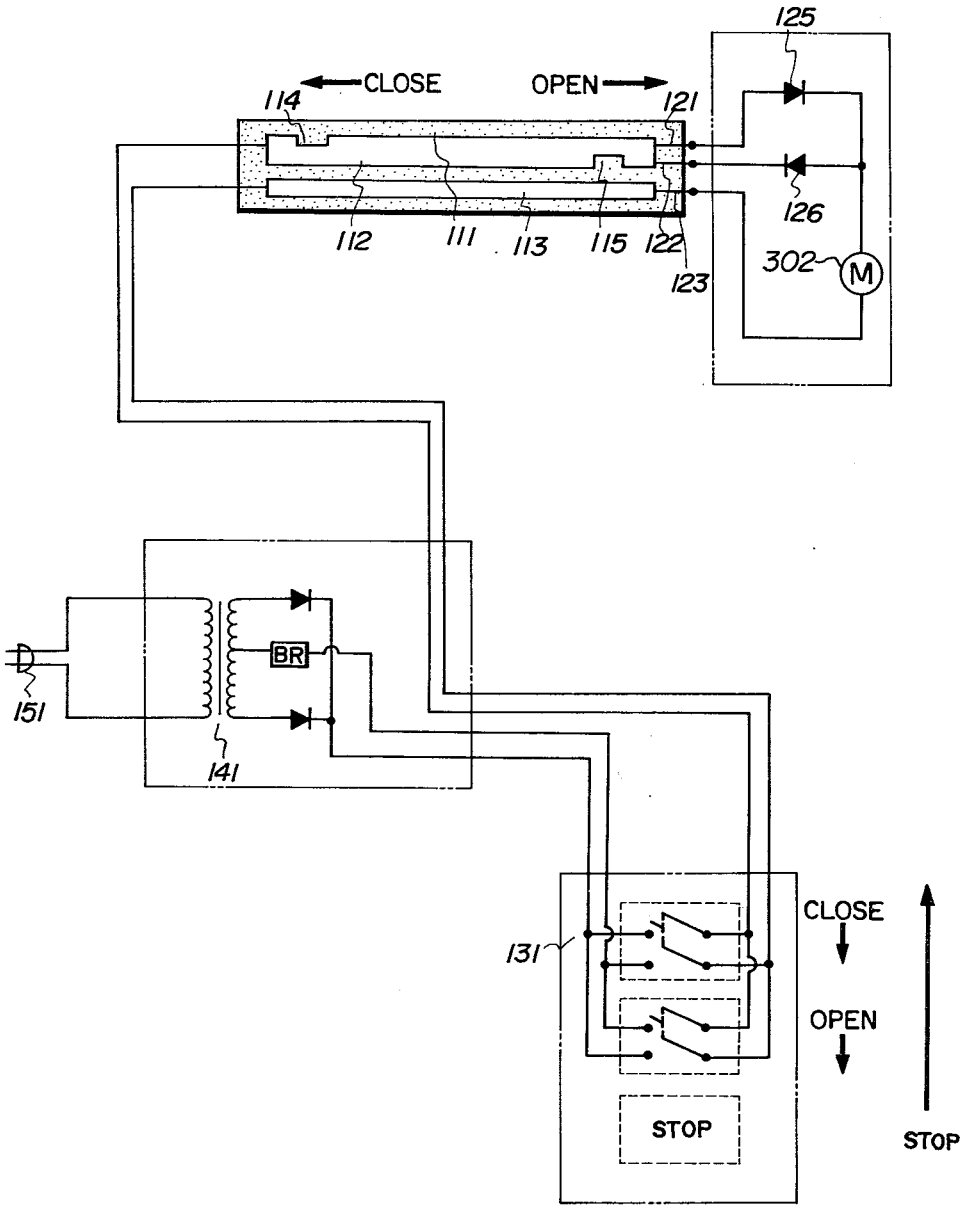
FIG. 3 is a wiring diagram in which the lead plate is schematically shown.
Figure 5:
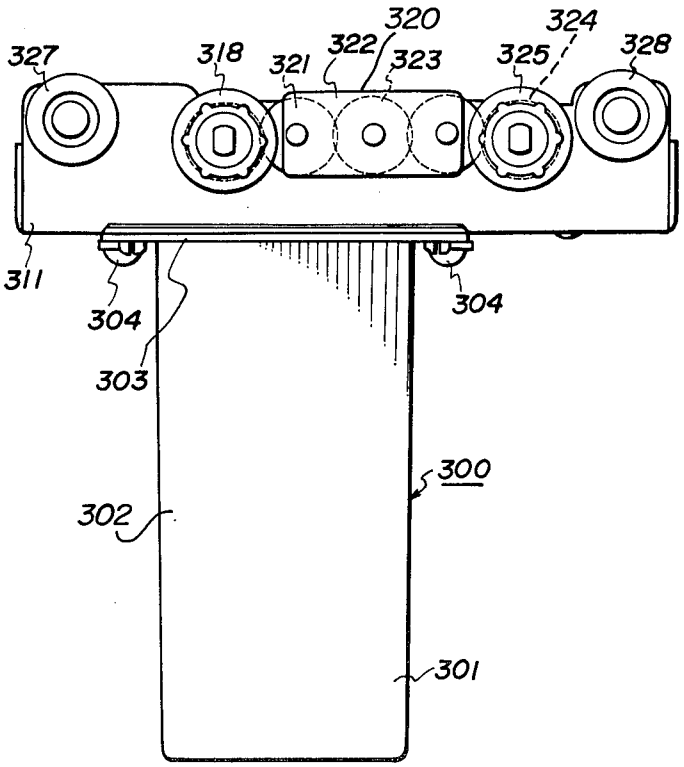
FIG. 5 is a side view of the motor-driven mechanism.

Turning in details to the lead plate 111, it is formed of an insulating synthetic resin material. As seen from FIG. 2, the lead plate is mounted on the inner face of the side member of rail 100 in such a manner that it engages with the projection 105 and grooves 106. More specifically, the lead plate 111 is inserted in the curtain rail 100 from its one end along the inner face thereof, with its upper and lower edges engaging with the grooves 106 and its one side engaging with the projection 105. The lead plate 111 is then provided on its other side, i.e., its side facing the hollow portion of the curtain rail 100, (see FIG. 3) with an upper lead line 112 of a larger width and a lower lead line 113 of a smaller width. Both the lead lines 112 and 113 are used to conduct current, and are composed of a conductive material that is formed into a thin tape. The lead line 112 has at the upper edge of its one end an insulating portion 114 that may preferably be formed by notching, and at the lower edge of the other end an insulating portion 115 that may preferably be formed by notching.

Figure 4:
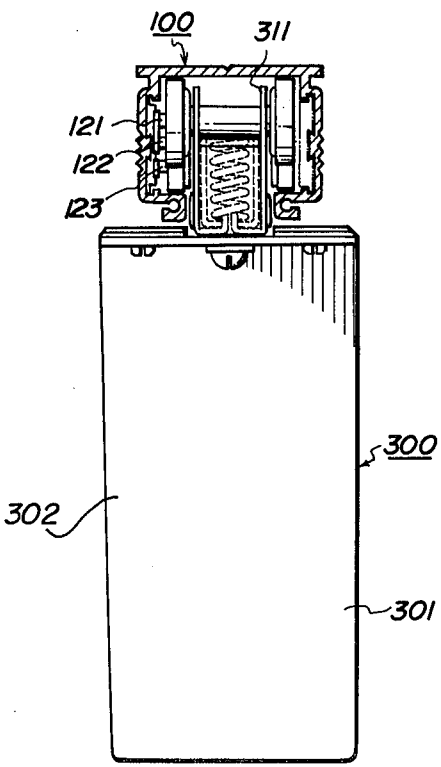
FIG. 4 is an end view of the motor-driven mechanism in which the section of the curtain rail is also shown.
Figure 6:
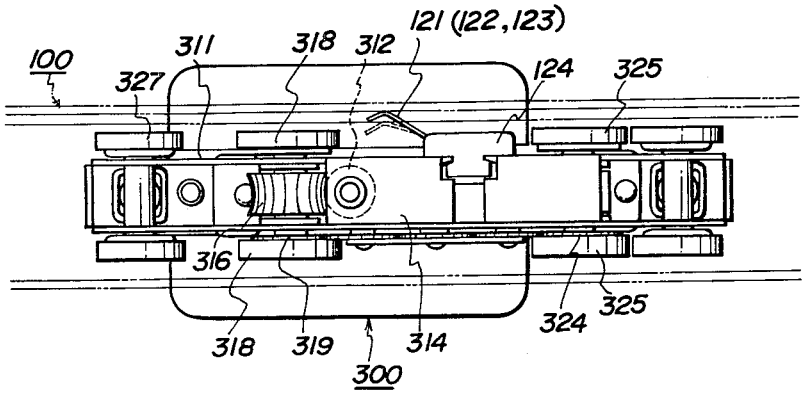
FIG. 6 is a plan view of the motor-driven mechanism.
Figure 7:
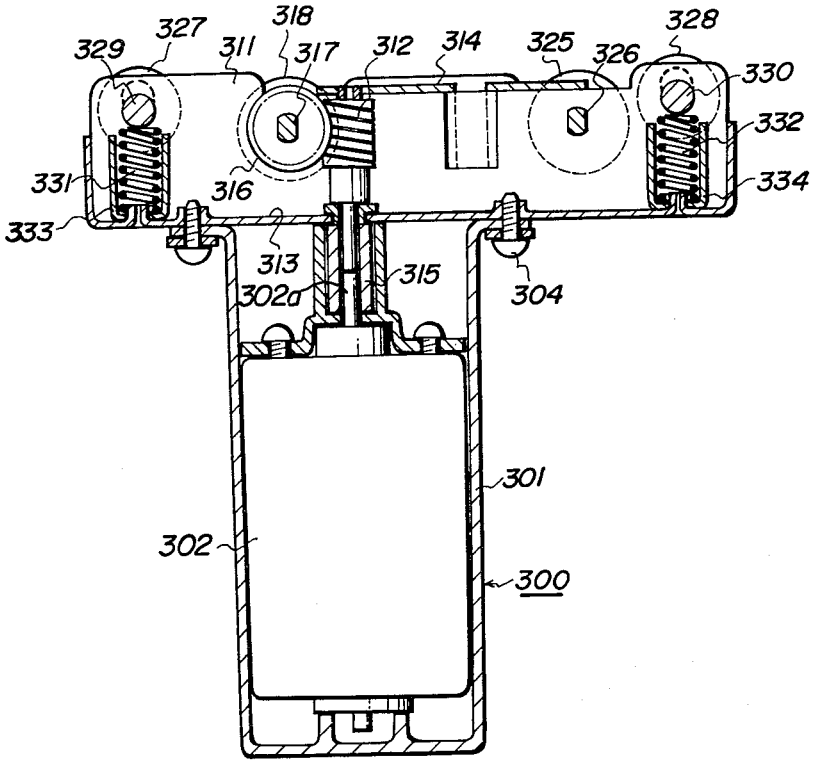
FIG. 7 is a longitudinal section of the motor-driven mechanism.

As will also be understood from FIG. 4, brushes 121, 122 and 123 are adapted to come in contact with the lead plate 111, i.e., the upper and lower lead lines 112 and 113. These brushes 121, 122 and 123 are mounted in a collector 124 (see FIG. 6). The lead lines 112 and 113, on the other hand, are connected with a control panel 131 for effecting drawing, and stopping of the curtain 400. The control panel 131 is in turn connected with a transformer 141 for converting a normal a.c. voltage into a voltage suitable for the operation of the curtain drawer arrangment according to the present invention. The transformer 141 is then in communication with a plug 141 of an a.c. power source. It is noted that a casing 301 (to be described later in connection with FIG. 7) includes therein diodes 125 and 126. The diodes 125 and 126 are connected with the brushes 121 and 122, respectively, and are in turn connected with a reversible motor 302 (see FIG. 7) disposed in the motor-driven mechanism 300. With such an arrangment, it is possible to cause rotation and contra-rotation of the motor 302 during operation.

A plurality of curtain runners 200 depend from the curtain rail 100 as shown in FIG. 1, and each includes a base portion 201 and a shaft 202 extending horizontally from both its sides, said shaft carrying wheels 203 at both its ends. The base portion 201 has a diameter somewhat larger than that of each wheel 203 so as to assure smooth rotation of wheels 203 when the curtain runners 200 collide or come in contact with each other. In addition, the curtain runners 200 are formed of a synthetic resin material that exhibits the required durability during use, and produces no noise due to collision and rotation. It is noted that each base portion 210 is provided at its lower end with an engaging means 204 of annular form depending therefrom.

The motor-driven mechanism 300 is adapted to depend from the curtain rail 100 together with the curtain runners 200, and basically comprises a travelling portion located in the curtain rail 100 and a power supply portion located below the curtain rail 100, as depicted in FIGS. 4 to 7. That is to say, power is supplied from a small-sized reversible motor 302 housed in a cylindrical casing 301 formed of an insulating synthetic resin material. The power, i.e., a rotational force, from the motor 302 is transmitted to the travelling portion, said portion being fixed to the upper end of casing 301 through a flange 303 by means of a screw 304.

The travelling portion includes, as shown in FIG. 4, a base frame 311 of U-shape section, which frame is of a size sufficient to fit loosely into the slot 101 formed in the curtain rail 100 in its entirety. More specifically, the base frame 311 is provided (see FIG. 7) in the substantial middle of its interior with a worm 312 having its shaft retained between the bottom and upper end plates 313 and 314 of the frame 311 through a bearing. Part of the shaft of worm 312 extending downwarly from the bottom plate 313 is coupled to the rotating shaft 302*a* of motor 302 by means of a joint 315. Within the base frame, a worm gear 316 rotatable with the rotation of worm 312 is carried on a shaft 317 disposed thereacross. Both ends of shaft 317 extend suitable lengths beyond the outer sides of frame 311, and each end is fitted with tired wheel 318. The wheel 318 has a spur gear 319 on its one side, viz., its side adjacent to the base frame 311. The worm gear 316, tired wheel 318 and spur gear 319 rotate simultaneously with the rotation of worm 312. The spur gear 319 is engaged with one outer gear 321 of three intermediate spur gears 321, 322 and 323 having their shafts retained between the side of frame 311 and an auxiliary plate 320 adjacent thereto. The other outer gear 323 is mated with a spur gear 324 which is constructed in a manner similar to the spur gear 319. According to such an arrangement, another tired wheel 325 is supported by a shaft 326 extending from the base frame 311, driven by the tired wheel 318 through the intermediate spur gears 321, 322 and 323. The said spur gear 324 is mated with an inner side of the tired wheel 325. This assures that the rotation of worm 312 causes simultaneous rotation of said tired wheels 318 and 325 at the same speed and in the same direction. It will be understood that the tired wheels 318 and 325 are retained on the base frame 311 in such a manner that, when mounted in the curtain rail 100, they come in constant contact with the tracks 102 of rail 100 on their lower faces.

While the foregoing arrangment may generally be moved along the tracks 102 of rail 100 by the rotation of tired wheels 318 and 325, the present invention provides additional means for surer operation of the arrangement, as will be discussed below.

The base frame 311 is provided at both its ends with wheels 327 and 328 adapted to abut tightly upon the inner upper face of rail 100. These wheels 327 and 328 are mounted on both ends of shaft extensions 329 and 330 fitted loosely in the longitudinally elongated slots formed in the side walls of both ends of frame 311. These shafts 329 and 330 are always biased up by the resiliency of coil springs 331 and 332. As illustrated, such coil springs 331 and 332 are housed in cases 333 and 334 fixed on the bottom plate 313 of frame 311. In this way, the wheels 327 and 328 assure that, even when the weight of the motor-driven mechanism 300 per se is small, the tired wheels 318 and 325 are tightly pressed against the faces of the tracks 102 of rail 100.

The curtain 400 is supported by the annular engaging means 204 depending from the curtain runners 200 which are in turn supported by hooks 401 attached to the upper side of curtain 400.

In use, the curtain drawer arrangement thus assembled operates as follows.

In a completely closed state as illustrated in FIG. 1, the arrangement is actuated by pushing the button on the control panel 131. A circuit comprising lead line 112, brush 121, diode 125, reversible motor 302, brush 123 and lead line 113 is then formed to actuate the motor 302. The motor 302 thus actuated causes rotation of worm 312 and hence rotation of worm gear 316, so that the tired wheel 318 is rotated. Rotation of the tired wheel 318 effects rotation of spur gear 319 which in turn effects rotation of intermediate spur gears 311, 322 and 323 as well as of spur gear 324, resulting in rotation of tired wheel 325. Rotation of these tired wheels 318 and 325 allows the motor-driven mechanism 300 to travel on the tracks 102 of curtain rail 100, so that the curtain runners 200 fitted in the rail 100, except the forward-most curtain runner, are successively pushed onward to open the curtain 400. At the time when the curtain 400 is completely opened, the brush 122 reaches the insulating portion 115 to break the circuit, so that the operation of reversible motor 302 and hence the travelling of the mechanism 300 come to a halt. In this way, the curtain 400 remains open.

To close the curtain 400, the arrangement is put in drawing operation by the manipulation of the button on the control panel 131. A circuit comprising lead line 113, brush 123, reversible motor 302, diode 126, brush 122 and lead line 112 is then formed to cause contra-rotation of the motor 302. The motor 302 thus actuated permits the mechanism 300 to move and push the fore-front curtain runner 200*f* (that is, the curtain runner 200 which is above that vertical edge of the curtain which is moved to and fro during curtain opening and closing operations) onward until the curtain 400 is fully closed. The brush 122 then reaches the insulating portion 115 to break the circuit. As a result, the movement of motor-driven mechanism 300 comes to a halt, and the curtain 400 remains closed.

It is noted that, even when it is expected that the curtain 400 increases in weight with the result that the tired wheels 318 and 325 spin, there is no possibility that difficulties or abnormalities may be encountered in the travelling of the motor-driven mechanism 300, since the wheels 327 and 328 remain pressed against the faces of the tracks 102 of rail 100.

As mentioned above, the present invention provides a novel curtain drawer arrangement which is free from any failures occurring in the case with limit switches, and prevents the motor-driven mechanism travelling in the curtain rail from spinning.

What is claimed is:

1. A curtain drawer arrangement comprising:

(a) a rail of generally inverted U-shape in vertical cross-section having a pair of tracks on the sides of a longitudinal opening, said U-shaped rail having therein a plurality of spaced, linearly extending conductors, (b) a motor-driven mechanism comprising:

(i) a motor beneath said rail and having an output shaft, (ii) a travelling portion in said rail having driven wheels engaging said pair of tracks, having resiliently urged means engaging said rail above said tracks for urging said wheels against said tracks, and having brushes engaging sad conductors in said rail, (iii) means connecting said motor to said travelling portion, and (iv) power transmission means including gears for transmitting power from said motor output shaft to said driven wheels.

2. The curtain drawer arrangement of claim 1, wherein at least two driven wheels are in engagement with each said track.

3. The curtain drawer arrangement of claim 1, said resiliently urged means engaging said rail being wheels.

4. The curtain drawer arrangement of claim 3, said first and second mentioned wheels and said brushes being the only elements of said motor-driven mechanism in engagement with said rail.

5. The curtain drawer arrangement of claim 1, a plurality of curtain runners carried by said rail and having means engaging said tracks, said motor-driven mechanism placed for engaging and pushing the forefront curtain runner for effecting curtain closing movement and for successively pushing the other curtain runners for effecting curtain opening movement.

6. The curtain drawer arrangement of claim 1, said conductors comprising first and second conductors, said travelling portion comprising first and second brushes engaging said first conductor and a third brush engaging said second conductor, and motor-direction determining means including said motor and control means for completing a circuit through said motor, said third brush and second conductor and through one or the other of said first and second brushes, and said first conductor.

* * * * *